US006775922B2

(12) United States Patent
Langley et al.

(10) Patent No.: US 6,775,922 B2
(45) Date of Patent: Aug. 17, 2004

(54) HAIR DRYER AND ATTACHMENT SYSTEM

(75) Inventors: Luther D. Langley, Sterling, IL (US); James E. McCambridge, Polo, IL (US)

(73) Assignee: Wahl Clipper Corporation, Sterling, IL (US)

( * ) Notice: Subject to any disclaimer, the term of this patent is extended or adjusted under 35 U.S.C. 154(b) by 2 days.

(21) Appl. No.: 10/290,897

(22) Filed: Nov. 7, 2002

(65) Prior Publication Data

US 2004/0088878 A1 May 13, 2004

(51) Int. Cl.[7] ..... A45D 1/00
(52) U.S. Cl. ..... 34/96; 34/97
(58) Field of Search ..... 34/96, 97, 98, 34/99; 392/383, 384, 385, 379, 380

(56) References Cited

U.S. PATENT DOCUMENTS

| | | | | |
|---|---|---|---|---|
| 1,951,269 A | | 3/1934 | Boeckx et al. | 132/9 |
| 3,937,231 A | | 2/1976 | Tucker et al. | |
| 4,192,325 A | | 3/1980 | Liedtke | |
| 4,827,105 A | | 5/1989 | Brown, Jr. | |
| 4,848,007 A | | 7/1989 | Montagnino | |
| 5,161,317 A | | 11/1992 | McDougall | |
| 5,394,620 A | * | 3/1995 | Chimera | 34/97 |
| 5,467,540 A | * | 11/1995 | Bastien | 34/97 |
| 5,598,640 A | | 2/1997 | Schepisi | |
| 5,649,370 A | | 7/1997 | Russo | |
| 5,661,910 A | | 9/1997 | Schepisi | |
| 5,715,847 A | | 2/1998 | Rolf et al. | 132/271 |
| 5,966,833 A | | 10/1999 | Andis et al. | |

OTHER PUBLICATIONS

Braun Swing 1200 super volume dryer with attachments, product photos, 2 pages, undated.
Rowenta Project Pro 1800 dryer, product photos, Rowenta Wereke GmbH, 2 pages, 2000.

* cited by examiner

*Primary Examiner*—Henry Bennett
*Assistant Examiner*—Camtu Nguyen
(74) *Attorney, Agent, or Firm*—Greer, Burns & Crain, Ltd.

(57) ABSTRACT

A hair dryer attachment system provides a dryer and a plurality of attachments. A fastening mechanism is provided so that multiple attachments are each securable to the generally circular or ovate dryer barrel using the same fastening technology. Each of the attachments forms part of the barrel, and when used with the preferred present shortened barrel, a so-called "standard-length" drier is provided which provides the additional benefits of the respective attachments, without being overly long so as to be cumbersome during use. Each attachment features an apron which is supported by the barrel and, with engagement formations on the barrel and complementary formations on the apron, the attachment is releasably secured to the barrel. Aeration barrel and finger/comb attachments are also provided.

27 Claims, 11 Drawing Sheets

HAIR DRYER AND ATTACHMENT SYSTEM

BACKGROUND

The present invention relates to hair styling devices, and particularly to hand held hair dryers of the type designed for use with attachments for altering the flow of air from the barrel of a hand held dryer.

Hand held dryers are well known for use in styling hair and are commonly used by both individuals and professional hair stylists. It is common for such dryers to be provided with a plurality of styling attachments, such as, but not limited to, combs for combing the hair while drying, diffusers for diffusing or dissipating the flow of air from the dryer barrel outlet to reduce the velocity of the dryer outlet air and spread the air over a larger surface area, and concentrators for concentrating and/or increasing the velocity of the air dispensed from the dryer barrel outlet.

Typically available hand held hair dryers are provided with a plurality of such attachments. When the user or stylist desires to employ one of the attachments, they are typically pressed onto the end of the dryer barrel and temporarily held there with a friction fit. Since the dryer outlet barrels are typically circular or ovate, the attachments are often provided with a tubular rear end of slightly larger diameter to form a mating friction fit with the barrel outlet. In use, the attachments are pressed onto the barrel outlet. It is also known to provide a resilient, biased lip on the rear end of the outlet which is resiliently retained within an inner diameter of the dryer outlet barrel. It is also known to clip the attachments onto the end of the barrel.

However, one drawback of such attachment scenarios is that the attachment often slips off the end of the generally smooth, cylindrical or ovate dryer barrel. In addition, when the attachment is relatively large and heavy, as is often the case with large diameter diffusers, there is insufficient retaining surface area between the dryer barrel and the attachment to securely retain the attachment on the barrel. As such, the conventional attachments are susceptible to becoming loosened or dislodged from the dryer barrel.

Thus, there is a need for a mechanism for attaching styling attachments onto cylindrical or ovate hand held hair dryer barrels which promotes secure yet releasable attachment. There is also a need for an attachment for a hand held hair dryer which is releasably lockable to the generally circular or ovate dryer barrel to prevent unwanted disconnection during use.

SUMMARY

Accordingly, the present hair dryer attachment system addresses the above-described needs by providing a dryer and a plurality of attachments. A fastening mechanism is provided so that multiple attachments are each securable to the generally circular or ovate dryer barrel using the same fastening technology. Each of the attachments forms part of the barrel, and when used with a shortened barrel, as is provided here in the preferred embodiment, a so-called "standard-length" drier is provided which provides the additional benefits of the respective attachments, without being overly long so as to be cumbersome during use. This advantage is especially pertinent to occasions when the user is drying/styling her or his own hair.

Another feature of the present system is an aeration barrel attachment, which provides a generally cylindrical or tubular body having a perforated sidewall and a blocked end. Air flowing into the body is emitted radially only, and not axially. Thus, hair can be gently dried from root to tip without overheating or drying out the scalp.

Still another feature of the present system is a finger attachment including a plurality of extending fingers, each of which is provided with at least one airflow opening for combing and drying the hair near the scalp. In addition, this configuration preferably provides increased lift of the hair and/or increased hair volume. It is contemplated that other attachments are provided with the system, depending on the application, such attachments including concentrators, diffusers and/or styling attachments.

In the preferred embodiment, the fastening technology is provided in the form of spaced, radially projecting lugs on the exterior of the dryer barrel which engage bayonet-type "J"-sockets in rear margins of the attachment. The attachments are each thus secured to the dryer barrel through the use of a "push-and-twist" motion. In this manner, the attachments are releasably locked to the dryer barrel, and unwanted disengagement of the attachment from the dryer barrel is prevented.

More specifically, in one embodiment, a combination of a hand held hair dryer and a plurality of styling attachments is provided, including a hair dryer including a housing and a barrel with an outlet, the barrel being provided with at least one engagement formation for retaining a styling attachment. A plurality of styling attachments are also provided, each attachment being provided with at least one complementary formation for releasably engaging the corresponding at least one engagement formation for releasably locking the attachment to the barrel, the at least one complementary formation being disposed on an apron of the corresponding attachment, the apron being configured for being supported by the barrel between the at least one engagement formation and the outlet.

DETAILED DESCRIPTION OF THE INVENTION

Figure 1:
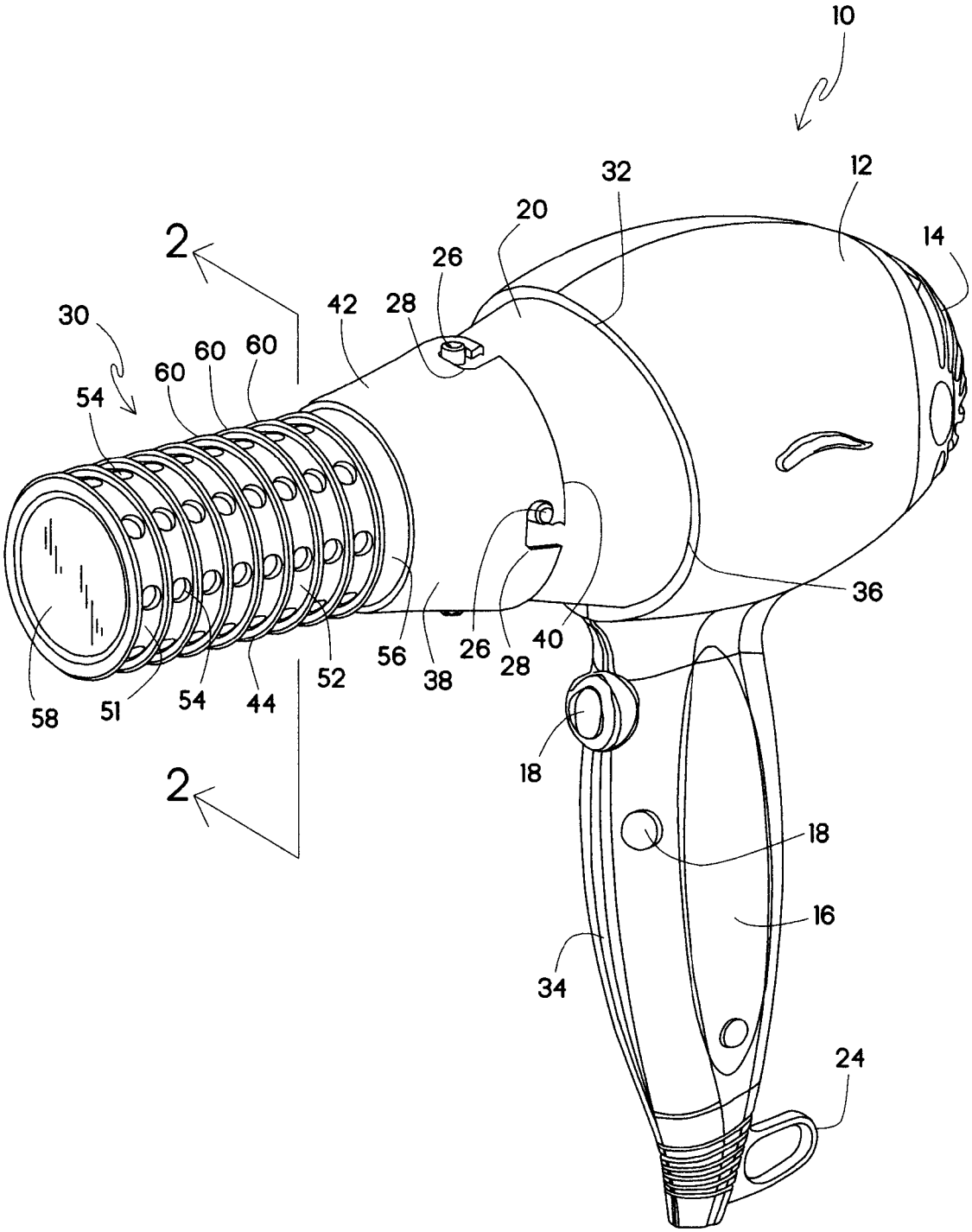
FIG. 1 is a top perspective view of a hair dryer provided with the present attachment system.
Figure 13:
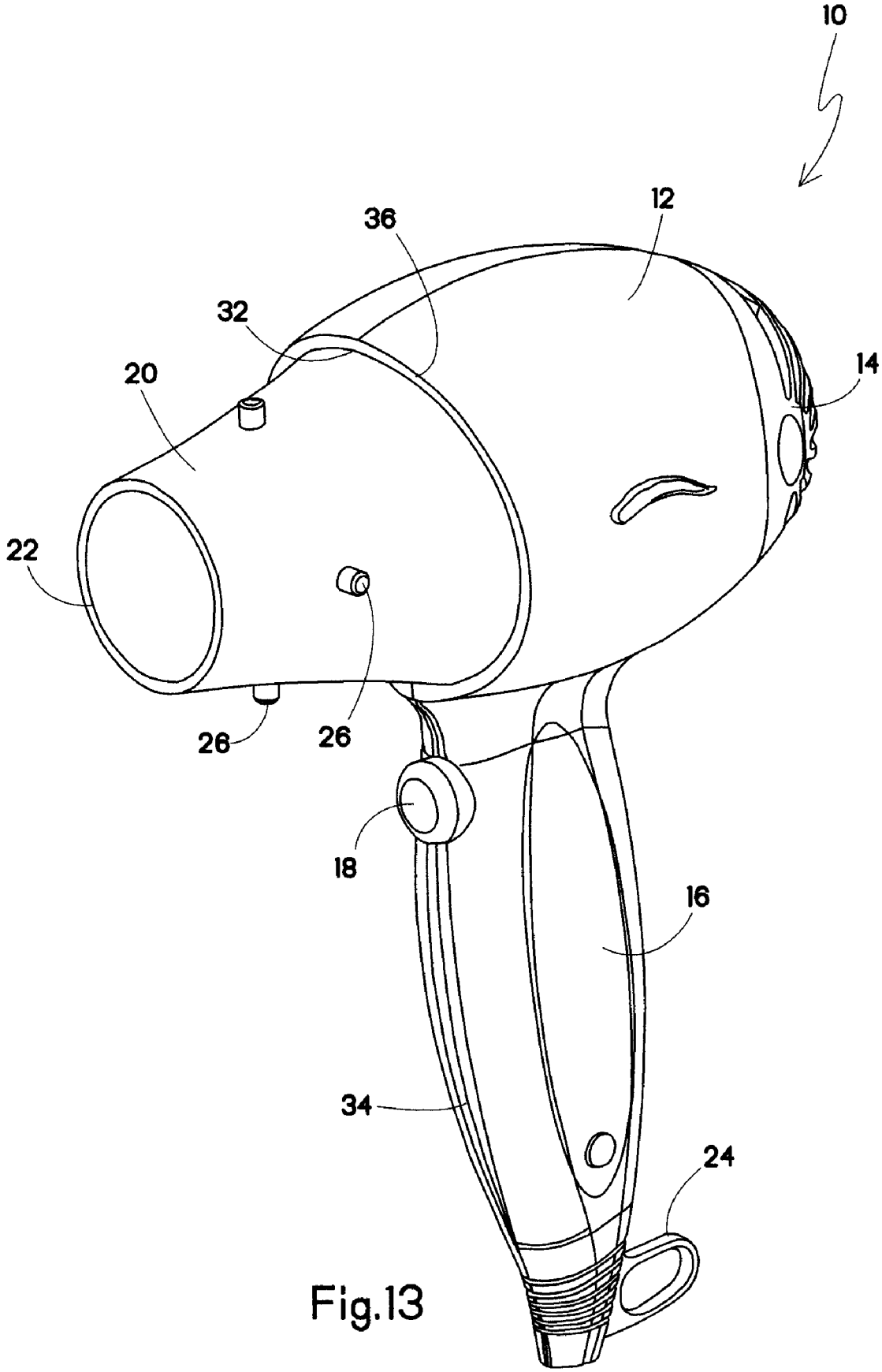
FIG. 13 is a top perspective view of the dryer of FIG. 1 shown without an attachment.

Referring now to FIGS. 1 and 13, a hand held hair dryer suitable for use with the present system is generally designated 10, and includes a housing 12 with an air intake 14, a handle 16, at least one switch 18 for controlling heat and/or fan speed as is known in the art, and a barrel 20 having an outlet 22. It is contemplated that the number and disposition of the switches 18 may vary to suit the application as is known in the art. Also, the barrel 20 is contemplated as preferably being generally cylindrical, cylindrical or ovate when viewed head on, and/or slightly tapered as is common in the art. Other barrel shapes are contemplated depending on the application. If desired, a hanging loop 24 may be provided for suspending the dryer 10 when not in use. Also, it is to be understood that the dryer 10 is provided with a fan, heating element, wiring and other internal components typically found in such products.

One of the features of the present invention is that the dryer 10 is provided with a plurality of attachments which are interchangeably attachable to the barrel 20. The attachment is a releasable locking arrangement which positively locates the attachment on the barrel to provide adequate support and to prevent unwanted disengagement of the attachment from the dryer 10. As will be seen, the attachments include straight barrels, diffusers, concentrators and styling attachments, the latter being provided with combs or projections, or being shaped for achieving specific hair styling characteristics.

To provide the desired releasable locking engagement between the barrel 20 and the attachments, the present system includes a fastening system including at least one engagement formation 26 on the barrel 20 for retaining a styling attachment thereto and a corresponding at least one complementary formation 28 on an attachment 30. In FIG. 1, the attachment 30 is an aeration-barrel attachment, described in greater detail below, however it is a feature of the present invention that all of the attachments are secured to the barrel 20 in the same way and are thus interchangeable. As such, 30 will also be used to refer to shared properties of all of the attachments.

Another feature of the present invention is that the barrel 20 of the dryer 10 is relatively short compared to conventional or "standard-size" dryers used by professional stylists and/or individuals. The length of the barrel 20 is measured from a first end 32 beginning at a general vertical line defined by a front edge 34 of the handle 16, and in the present dryer 10 is also represented by an optional ornamental shoulder 36 on the housing 12, and the outlet 22. It will be seen that the attachments 30 each form part of the overall barrel of the dryer 10, and as such shorten the working length of the dryer while providing a variety of styling alternatives.

Figure 2:
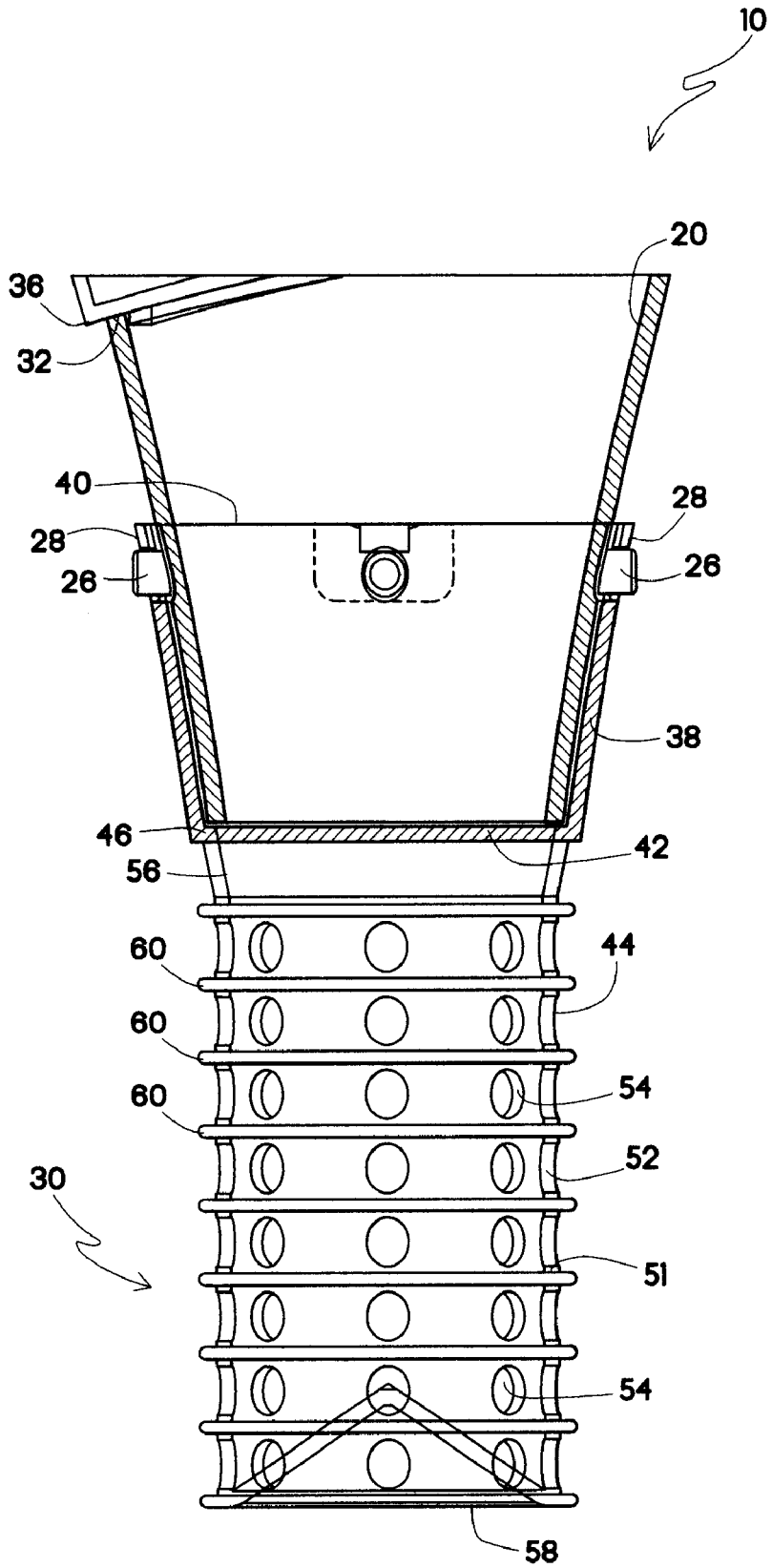
FIG. 2 is a vertical section taken along the line 2—2 of FIG. 1 and in the direction indicated.
Figure 3:
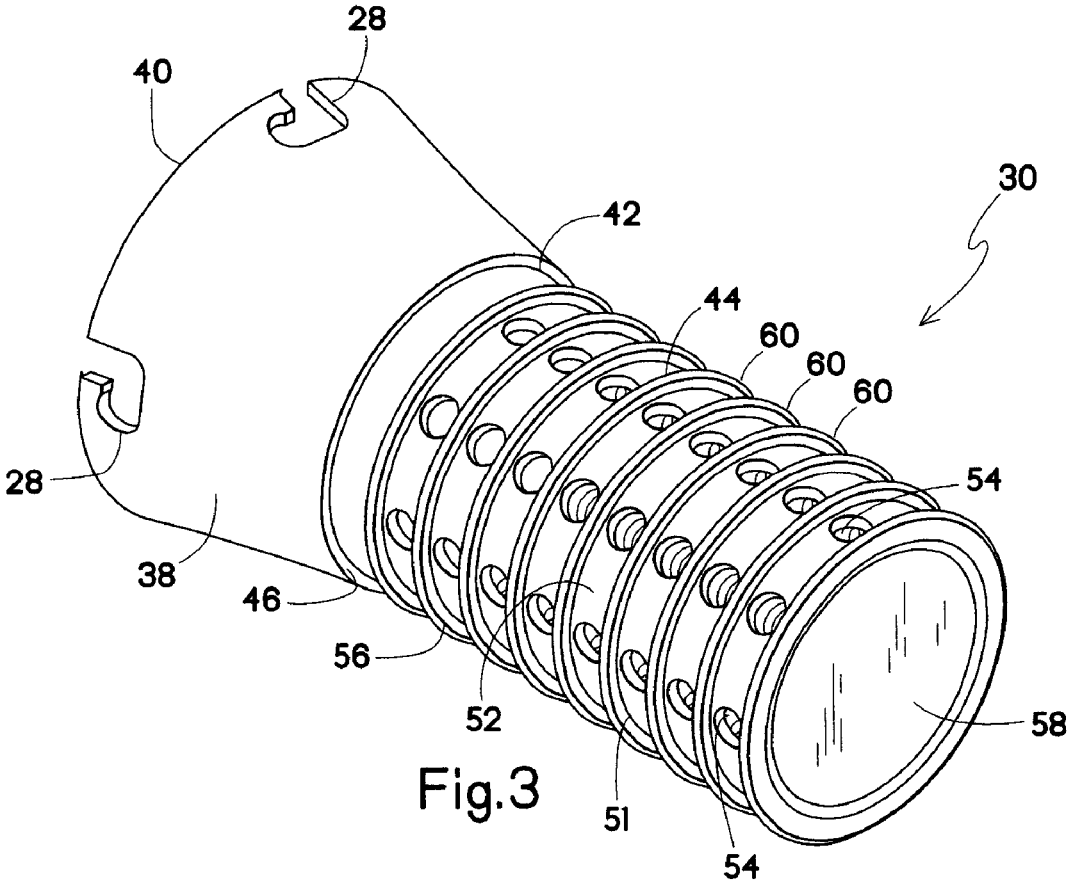
FIG. 3 is a top perspective view of a first, aeration barrel attachment usable with the present system.
Figure 4:
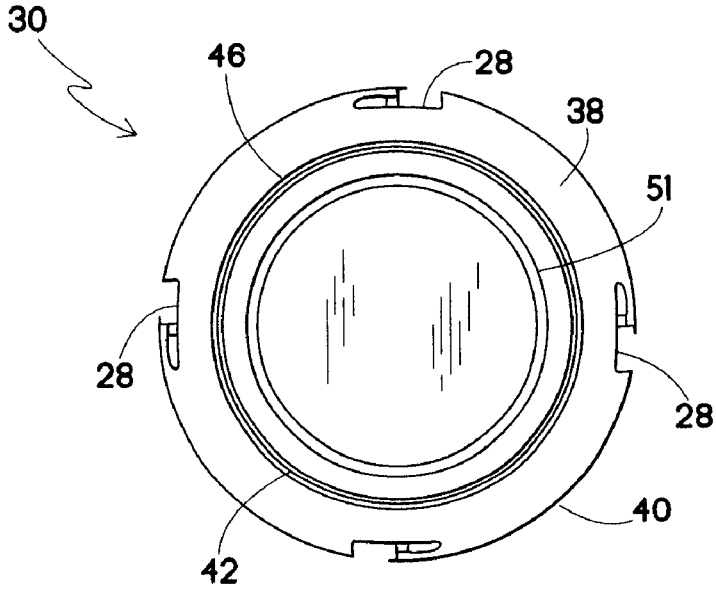
FIG. 4 is a front end view of the attachment of FIG. 3.
Figure 14:
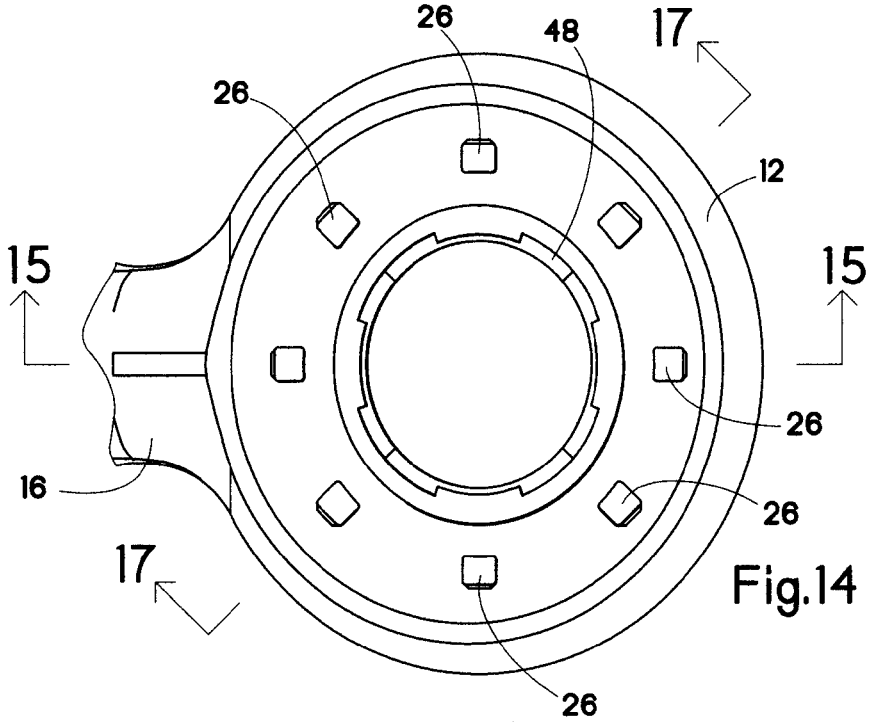
FIG. 14 is a fragmentary end view of the dryer of FIG. 13.
Figure 15:
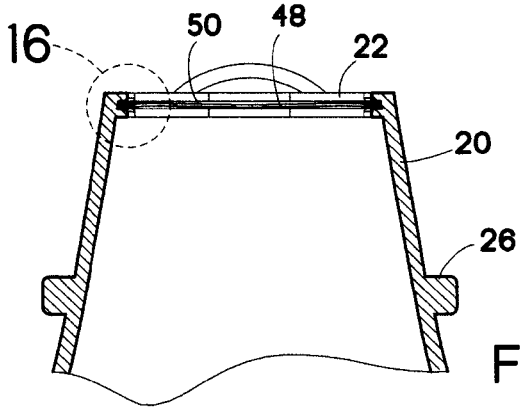
FIG. 15 is a fragmentary section taken along the line 15—15 of FIG. 14 and in the direction indicated generally.
Figure 16:
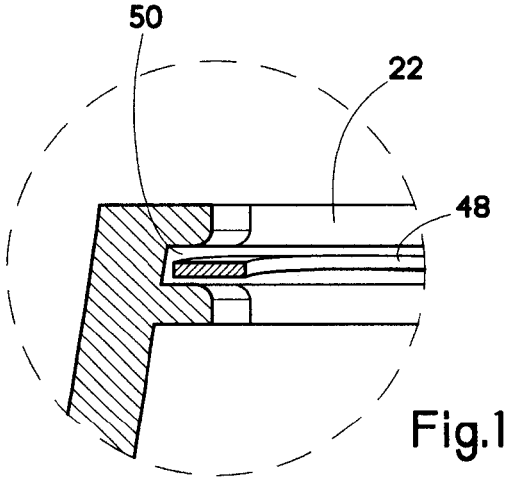
FIG. 16 is an enlarged portion of FIG. 15.
Figure 17:
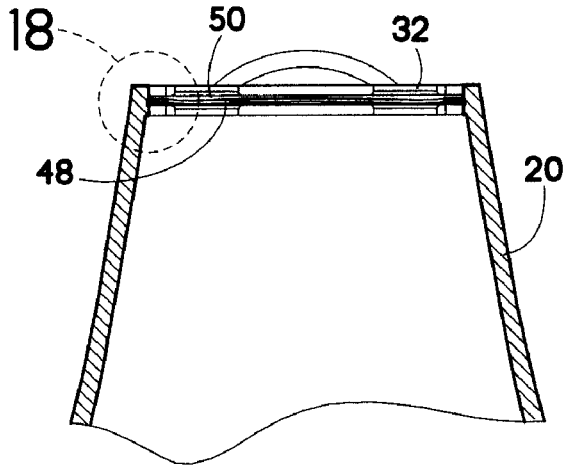
FIG. 17 is a fragmentary section taken along the line 17—17 of FIG. 14 and in the direction indicated generally.
Figure 18:
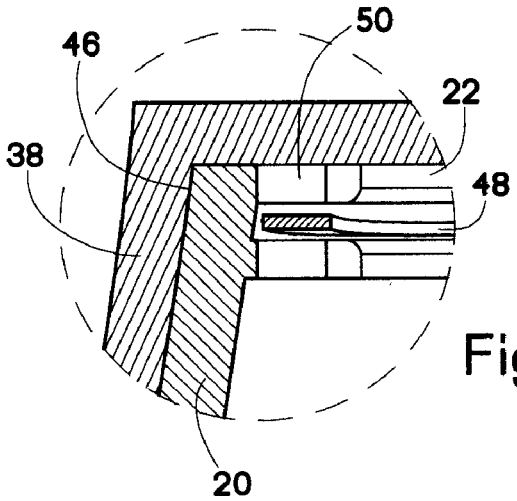
FIG. 18 is an enlarged portion of FIG. 17.

Referring now to FIGS. 1, 2 and 13, the attachment fastening system will be described in greater detail. The attachment 30 includes at least one and preferably a plurality of complementary formations 28 which are preferably equal to the number of engagement formations 26 on the barrel 20. In the preferred embodiment, the engagement formations 26 are radially extending lugs, and the complementary formations 28 are "J"-shaped bayonet-type notches or recesses disposed on an apron 38 of the attachment. Thus, a bayonet-lug attachment arrangement is provided, as is known in the mechanical arts. In the preferred embodiment, there are four engagement formations 26 positioned at approximate 90° increments around the barrel 20 and aligned on a common plane, however the number and spacing of the formations 26, 28 may vary to suit the application, and approximate 45° lug spacing is also shown in FIG. 14. This spacing of the formations 26, 28 permits the attachments 30 to be oriented at different positions on the barrel 20 as desired by the user.

The apron 38 is generally flared, having a larger diameter at a first end 40 than a second end 42 which is adjacent a working portion 44 of the attachment 30. Also, the complementary formations 28 are located closely adjacent the first end 40. The apron 38 is configured for being supported by the barrel 20 between the engagement formations 26 and the outlet 22. As such, the apron 38 is slidably and rotatably engageable on the barrel 20 for easy installation and removal by the user. At the same time, the apron 38 is intended to be positively located on the barrel 20.

In addition to the engaging formations 26, 28, and the physical support provided by the close proximity of the barrel 20 to the apron 38 (best seen in FIG. 2), the apron 38 also locates the outlet 22 in a positive and consistent manner. This location is obtained with a stop 46, which in the preferred embodiment is a shoulder formed by the apron 38 as it is attached to the working portion 44. Such attachment is typically obtained by integrally molding or forming the attachment 30 with the apron 38, however other fastening technologies are contemplated, including but not limited to chemical adhesive, ultrasonic welding, and threaded fasteners. The stop 46 is constructed and arranged to be axially displaced from an opening defined by the first apron end 40, and to positively engage the outlet 22 so that the engagement formations 26 properly engage the complementary formations 28 to achieve the releasable locking relationship of bayonet-style or other mating formations.

Another factor in achieving a positive positioning and retention of the attachment 30 on the barrel 20 is that the engagement formations 26 are preferably axially displaced from the outlet 22, and in the preferred embodiment are located approximately midway on the length of the barrel 20 between the first end 32 and the outlet. In the preferred embodiment, the engagement formations 26 are displaced approximately 1–1.5 inches from the outlet 22, however other distances are contemplated depending on the application.

Referring now to FIGS. 14–18, in the preferred embodiment it is desirable to provide a biasing force which urges the stop 46 away from the outlet 22 when the attachment 30 is engaged on the barrel 20. This biasing force will enhance the retentive capabilities of the formations 26, 28. More specifically, while it is contemplated that the biasing force may be mounted on either the attachment 30 or the barrel 20 it is preferred that the force be mounted to the barrel 20, particularly at or adjacent to the outlet 22. A Belleville washer, or other spring 48 is partially captured within a track 50 in the outlet 22 so that the washer 48 extends beyond the outer edge of the outlet. Alternatively, the attachment 30 could be provided with an axially projecting boss configured to engage the washer 48 in the track 50. In this manner, the washer 48 will engage the stop 46 of the apron 38 to exert the needed biasing force. The track 50 does not extend fully around the diameter of the outlet 22 so that the spring 48 may axially protrude as desired.

Referring now to FIGS. 1–4, the attachment 30 will be described in greater detail. It will be appreciated that for all of the attachments, the apron 38, the stop 46 and the formations 28 will be the same regardless of the type of working portion 44 provided. As such, the apron 38 will not be described for each attachment. It will also be appreciated that one of the features of the present system is that all of the attachments are axially longer than the barrel 20.

The attachment 30 is referred to as an aeration barrel attachment having a substantially tubular body 51 having a perforated sidewall 52 with rows of openings 54. A first end 56 of the attachment 30 is connected to the apron 38 for receiving the barrel 20, and a second end 58 is blocked off to prevent any axial airflow, such that all air flows radially through the sidewall 52. In addition, the attachment 30 is preferably provided with a plurality of axially spaced, radially projecting annular ribs 60 which are secured to the sidewall 52.

In use, the attachment 30 delivers an air stream under medium to long hair, and is intended to be used with a brush. The ribs 60 are designed to part and separate the hair, strands of which flow between the ribs and are dried by air emitted from the openings 54. Using this attachment 30, the hair is dried from the root to the tip, preferably without overheating or drying out the scalp. In this manner, a gentle alternative is provided to the relatively violent and aggressive turbulence associated with standard barrel dryers set at high heat/high fan speed.

Figure 5:
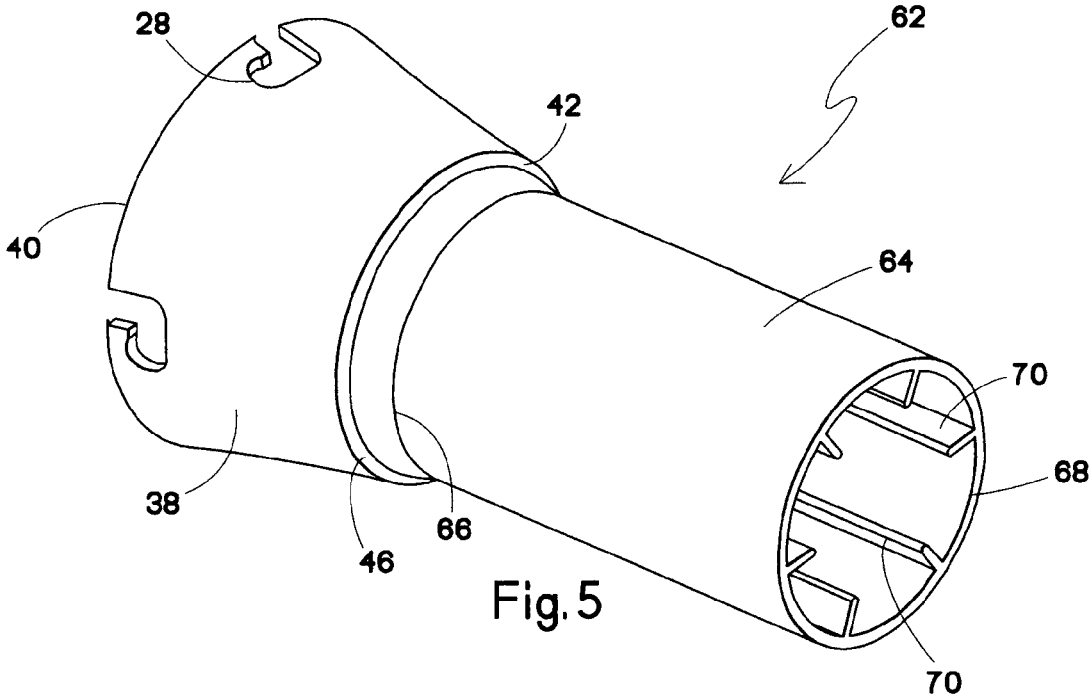
FIG. 5 is a top perspective view of a second, straight barrel attachment usable with the present system.

Referring now to FIG. 5, another attachment is depicted, referred generally as a straight barrel 62. This attachment is used to provide more conventional drying, and includes a generally cylindrical sidewall 64 having a first end 66 connected to the apron 38 and a second or outlet end 68. A feature of the attachment 62 is that at least one and preferably a plurality of generally axially directed fins 70 are located about the inner surface of the sidewall 64 to uniformly align the airflow. This is intended to reduce a vortex effect of the airflow and reduce the dryer noise level.

Figure 6:
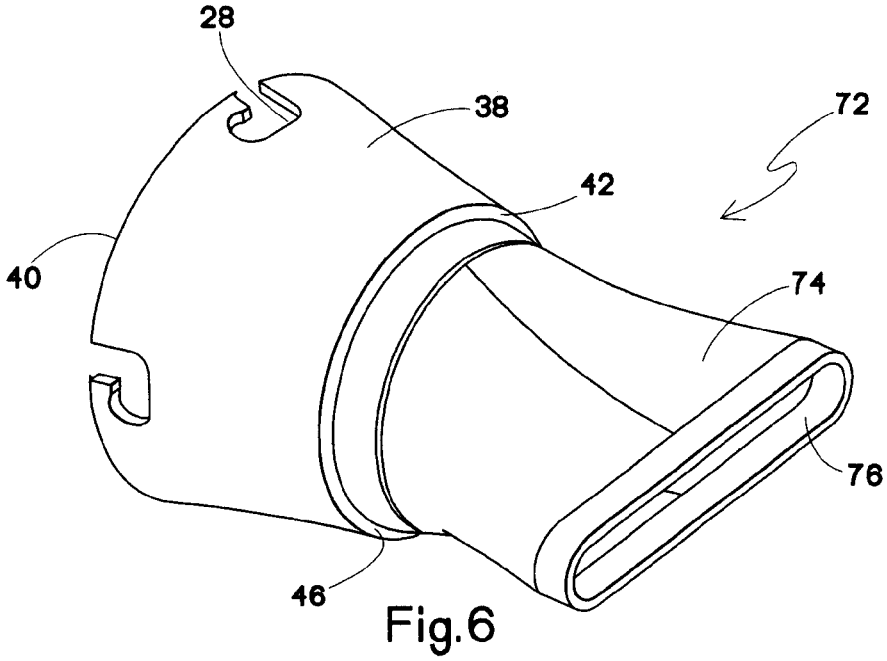
FIG. 6 is a top perspective view of a third, concentrator attachment usable with the present system.

Referring now to FIG. 6, another attachment is referred to as a concentrator 72, and features a generally flattened body 74 with an elongated, narrowed outlet 76. As is known in the art, this type of attachment is used for velocity enhancement and focusing of the airflow emitted from the outlet 22. The emitted air forms a fan-shaped pattern and is intended to achieve greater control and drying efficiency in a smaller area.

Figure 7:
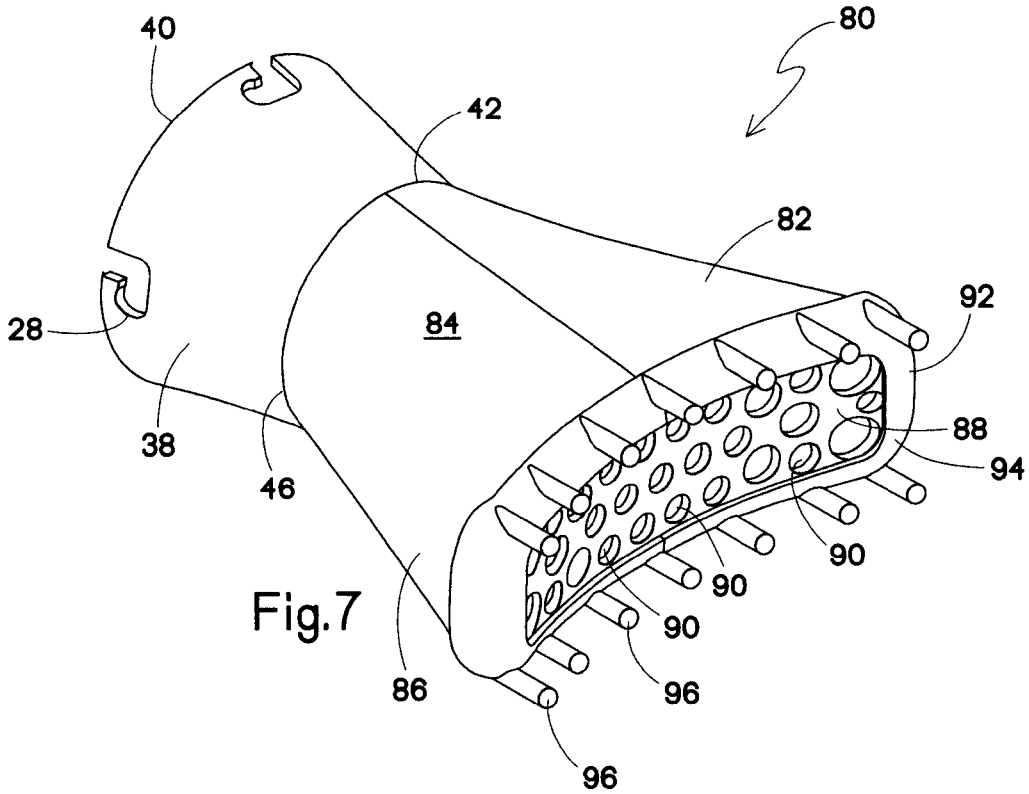
FIG. 7 is a top perspective view of a fourth, contoured diffuser attachment usable with the present system.
Figure 8:
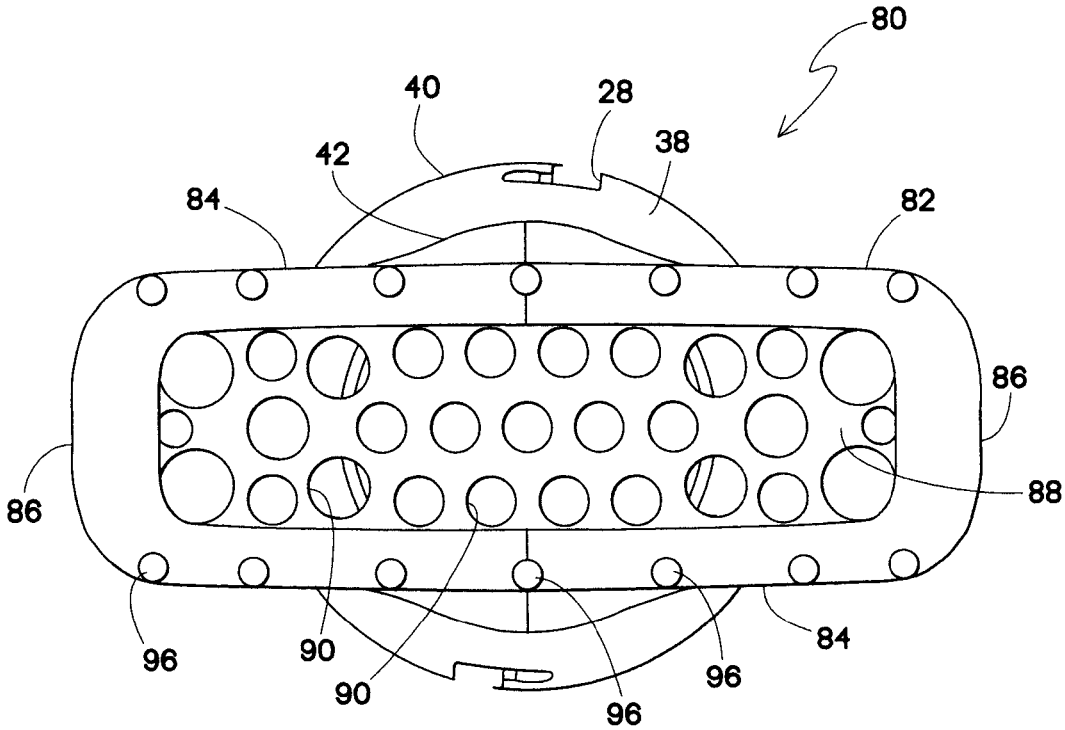
FIG. 8 is a front end view of the attachment of FIG. 7.

Referring now to FIGS. 7 and 8, another attachment is referred to as a contour diffuser 80, and features a generally flattened body 82 with a pair of generally parallel main sidewalls 84 connected by endwalls 86 and a concave outlet 88 with a plurality of airflow openings 90. The openings 90 are dimensioned to collectively provide an airflow surface area which is in parity, or approximates the surface area defined by the diameter of the outlet 22. More specifically, as is seen in FIG. 8, the openings 90 have a larger diameter on the periphery of the outlet 88 as compared to the middle. This is intended to equalize the airflow across the entire outlet 88.

The result is an airflow which-is contoured to the scalp by the outlet 88. This type of attachment 80 is preferred when the hairstyle requires a delicate application of air, such as when the hair has been permed or curled, or colored. Another feature of the present attachment 80 is a detachable comb 92 having a collar 94 and a pair of rows of spaced teeth 96. The comb 92 is releasably secured to the body 82 by friction fit, clips or tabs (not shown) as is known in the art.

Figure 9:
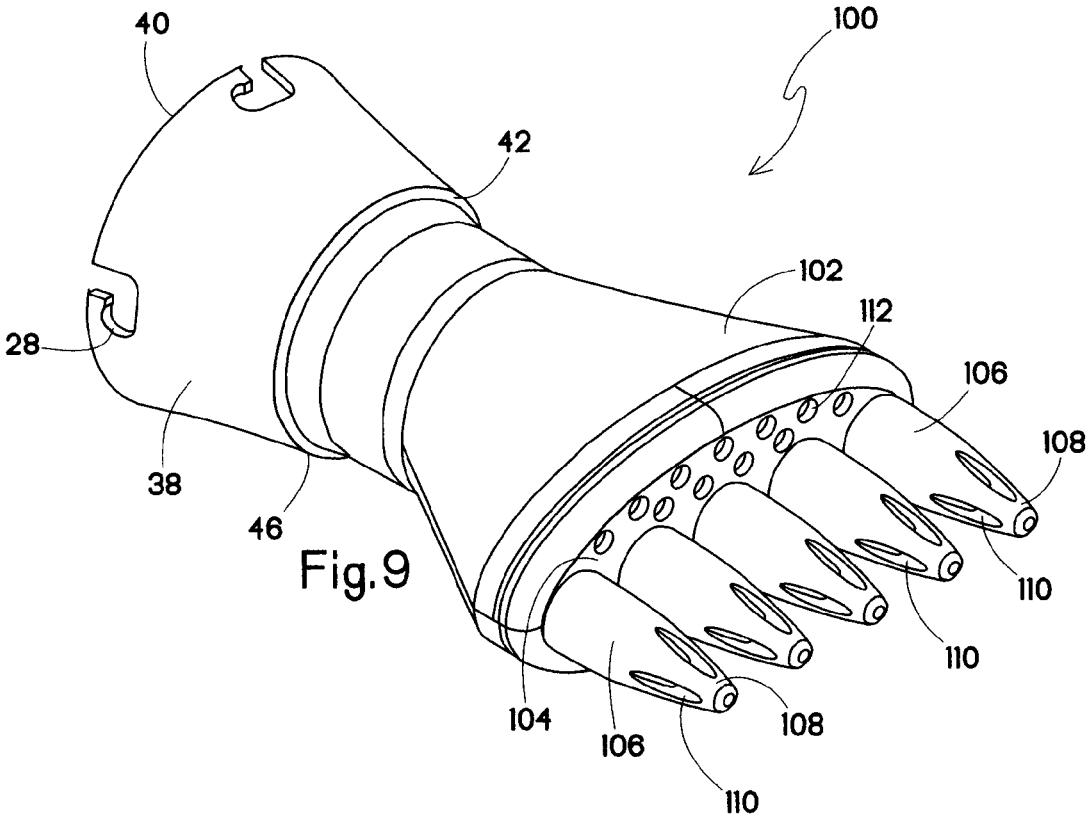
FIG. 9 is a top perspective view of a fifth, finger attachment usable with the present system.
Figure 10:
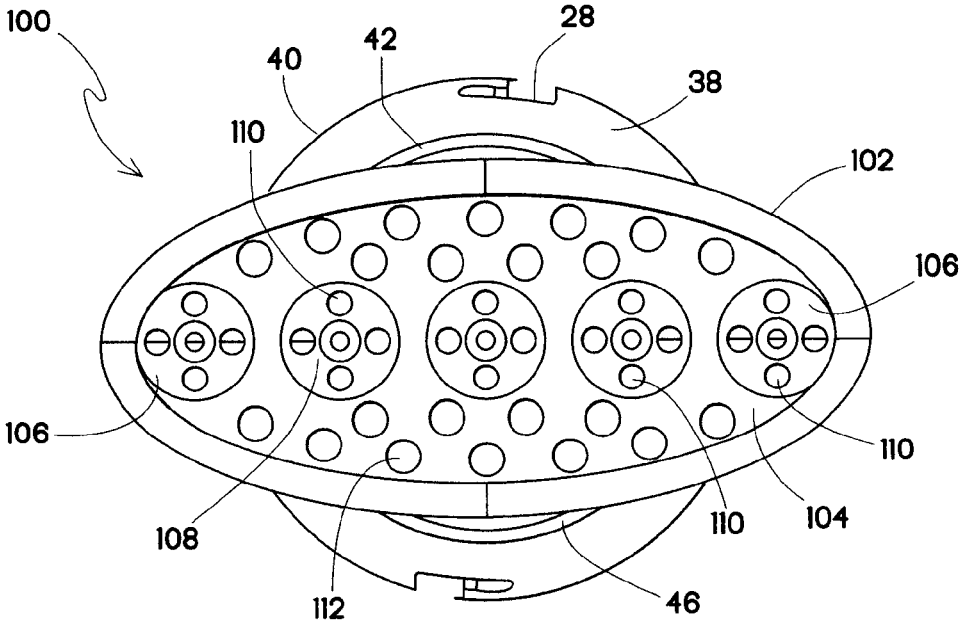
FIG. 10 is a front end view of the attachment of FIG. 9.
Figure 11:
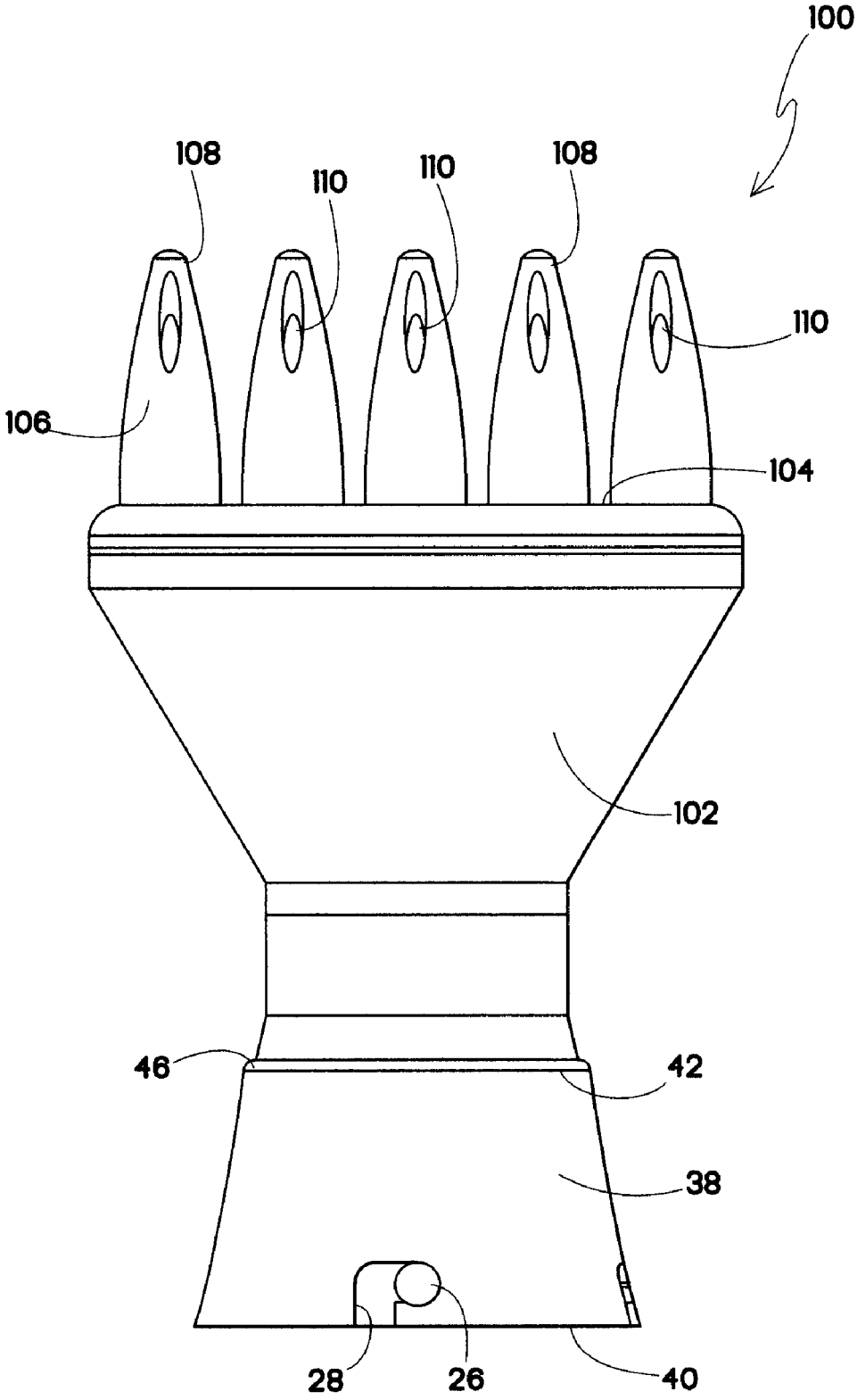
FIG. 11 is a plan view of the attachment of FIG. 9.

Referring now to FIGS. 9–11, still another attachment is referred to as a finger or finger diffuser 100, having a generally flattened body 102 appearing generally triangular when viewed from above, and a perforated, generally planar outlet 104 from which projects a plurality of fingers 106. The fingers 106 preferably taper from the outlet 104 towards their respective tips 108, and are disposed in a line which is generally parallel to a plane defined by the body 102. Each finger 106 preferably has at least one airflow opening 110 associated with the tip 108, and in the depicted embodiment, there are five such openings 110, one at the very tip being smaller than the other four (best seen in FIG. 9). As is seen in FIG. 10, perforations 112 are generally evenly spaced across the outlet 104.

An advantage of the diffuser 100 is that the fingers 106 act as a comb for styling the hair and also penetrate through the layers of hair for more thorough drying at the scalp, which is the preferred method for beginning the hair drying process. The multiple openings 110 facilitate this type of drying.

Figure 12:
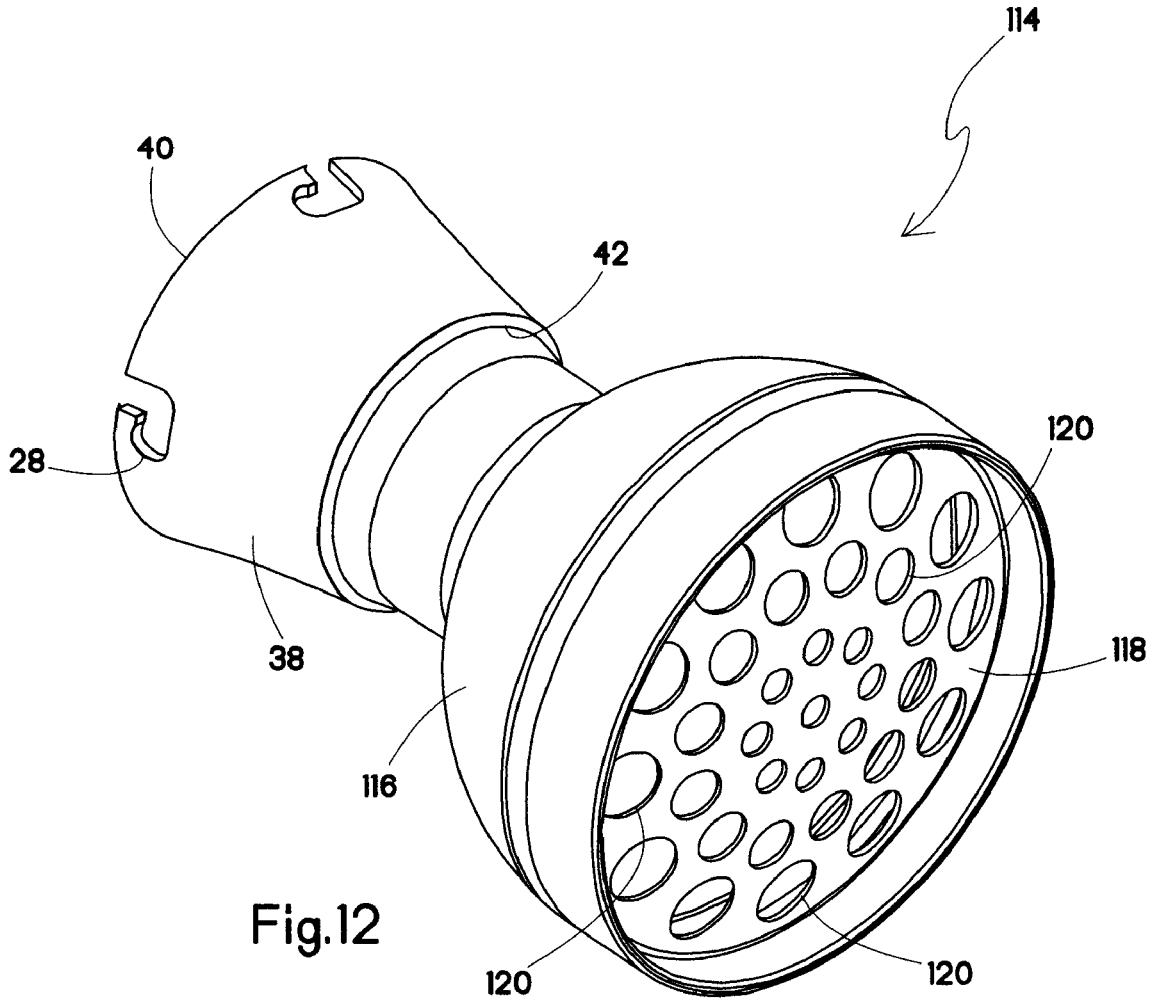
FIG. 12 is a top perspective view of a sixth, grand diffuser attachment usable with the present system.

Referring now to FIG. 12, a grand diffuser is generally designated 114 and has a generally bowl-shaped body 116 with a circular outlet 118. The outlet 118 has a plurality of airflow openings 120 which generally have a larger diameter on the periphery than at the center. The diameter of the outlet 118 is considerably larger than the dryer outlet 22 and generates a focused airflow over a larger area. Relatively gentler air streams are emitted, and the variations in the diameters of the openings provide for more even distribution of emitted air.

Figure 19:
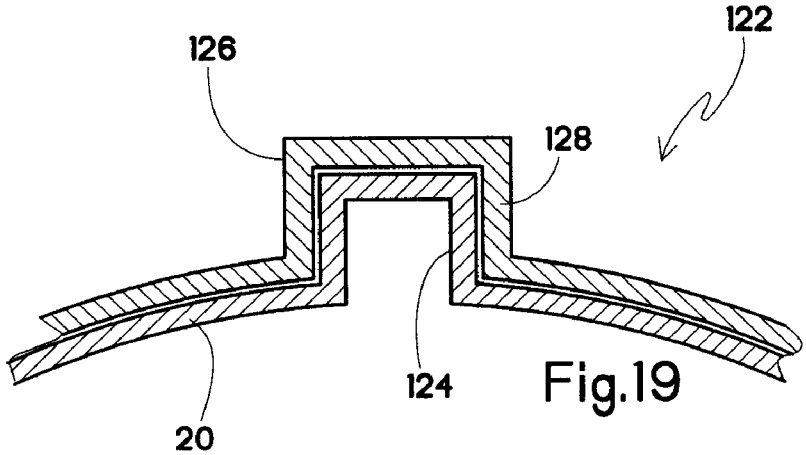
FIG. 19 is a fragmentary vertical section of an alternate attachment fastening formation suitable for use with the present system.

Referring now to FIG. 19, an alternate embodiment to the formations 26, 28 is generally designated 122. Components which are shared with the system depicted in FIGS. 1–18 are designated with identical reference numbers. Instead of the bayonet-type lugs 26 and notches 28, the barrel 20 is provided with at least one and preferably a plurality of spaced friction fit blocks or wedges 124 which project radially from the barrel 20 in a similar fashion to the lugs 26. The specific shape of the blocks 124 may vary to suit the application. The blocks 124 are received in capture sockets 126 which are generally closed but have an open end 128. It is preferred that the sockets 126 are dimensioned to slidably, frictionally receive the blocks 124 as the attachment 30 is pushed and rotated upon the barrel 20, as occurs with any of the attachments described herein. Other types of rotationally activated fastening systems are contemplated depending on the application. It is preferred that the fastening system permit the attachment 30 to be positioned in multiple orientations relative to the barrel 20 as may be needed by the user.

Thus, it will be seen that the present hair dryer and attachment system provides a dryer with a shortened barrel, and a system for receiving a multitude of attachments which are positively secured in place. At the same time, the attachments are supported, yet are easily removed by the user as needed depending on the desired hairstyle. The shorter barrel allows the attachments to be relatively long and provide substantial styling benefits without overly increasing the length of the dryer.

While a particular embodiment of the present hair dryer and attachment system has been described herein, it will be appreciated by those skilled in the art that changes and modifications may be made thereto without departing from the invention in its broader aspects and as set forth in the following claims.

What is claimed is:

1. A combination of a hand held hair dryer and a plurality of styling attachments, comprising:

a hair dryer including a housing and a generally tapered barrel with an outlet, said barrel being provided with at least one engagement formation for retaining a styling attachment thereto;

a plurality of styling attachments, each said attachment being provided with at least one complementary formation for releasably engaging said corresponding engagement formation for releasably locking said attachment to said barrel, said at least one complementary formation being disposed on an apron of said corresponding attachment, said apron being generally flared and being configured for being supported upon engagement by an overlapping portion of said apron and a corresponding tapered portion of said barrel between said at least one engagement formation and said outlet.

2. The combination of claim 1 wherein said at least one engagement formation is displaced axially from said outlet.

3. The combination of claim 1 wherein said housing has a handle with a front edge generally defining a line, and said barrel has a first end opposite said outlet which is generally aligned with said line.

4. The combination of claim 3 wherein said at least one engagement formation is disposed approximately midway between said first end and said outlet.

5. The combination of claim 1 wherein said at least one engagement formation is a radially extending lug.

6. The combination of claim 1 wherein said at least one engagement formation is a plurality of formations disposed at approximate 90° intervals around said barrel.

7. The combination of claim 1 wherein said at least one engagement formation is a plurality of formations disposed at approximate 45° intervals around said barrel.

8. The combination of claim 1 wherein each said attachment defines a stop on said apron which is configured for receiving said outlet of said barrel.

9. The combination of claim 8 wherein said stop is disposed on said apron to properly align said engagement formation with said corresponding at least one complementary formation for ensuring releasable locking engagement between said attachment and said barrel, said attachment is dimensioned to slidably and rotatably engage said barrel.

10. The combination of claim 8 wherein said barrel is provided with a biasing force urging said stop away from said outlet.

11. A combination of a hand held hair dryer and a plurality of styling attachments, comprising:

a hair dryer including a housing and a barrel with an outlet, said barrel having a length and being provided with at least one engagement formation for retaining a styling attachment thereto;

a plurality of styling attachments, each said attachment being provided with at least one complementary formation for engaging said corresponding engagement formation for releasably locking said attachment to said barrel, each said attachment having a length, such that each of said attachments is longer than said barrel wherein said housing has a handle with a front edge generally defining a line, and said barrel has a first end opposite said outlet which is generally aligned with said line, said at least one engagement formation is disposed approximately midway between said first end and said outlet.

12. The combination of claim 11 wherein said at least one complementary formation is disposed on an apron of said corresponding attachment, said apron being generally flared and being configured for being supported upon engagement by an overlapping portion of said apron and a corresponding tapered portion of said barrel between said at least one engagement formation and said outlet.

13. The combination of claim 12 wherein each said attachment defines a stop on said apron which is configured for receiving said outlet of said barrel, said stop is disposed on said apron to properly align said engagement formation with said corresponding at least one complementary formation for ensuring releasable locking engagement between said attachment and said barrel, said attachment is dimensioned to slidably and rotatably engage said barrel.

14. The combination of claim 11 wherein one of said attachments is an aeration barrel having a substantially tubular body with a perforated sidewall, a first end for receiving the barrel, and a second end which configured for blocking air flow, such that all air flows radially through said sidewall.

15. The combination of claim 11 further including a plurality of spaced, radially projecting annular ribs provided to said sidewall, said ribs separating adjacent perforations in said sidewall.

16. The combination of claim 13 wherein said attachments are taken from a group consisting of at least one concentrator attachment, at least one diffuser attachment, at least one straight barrel attachment and at least one styling attachment.

17. The combination of claim 11 wherein said attachments include a vertically flattened contoured diffuser with a concave outlet, a plurality of airflow openings in said outlet such that the openings collectively provide an airflow surface area which is on a parity with a diameter of said barrel outlet.

18. The combination of claim 17 further including a detachable comb configured for engagement upon said concave outlet.

19. The combination of claim 11 wherein said attachments include a finger diffuser having a perforated outlet from which projects a plurality of fingers, each said finger having a tip with at least one airflow opening associated with said tip.

20. The combination of claim 19 wherein said fingers are linearly aligned along a plane which is parallel to a plane defined by a body of said attachment.

21. A combination of a hand held hair dryer and a plurality of styling attachments, comprising:

a hair dryer including a housing and a barrel with an outlet, said barrel being provided with at least one engagement formation for retaining a styling attachment thereto;

a plurality of styling attachments, each said attachment having a first end having at least one complementary formation operatively associated therewith for engaging said corresponding engagement formation for releasably locking said attachment to said barrel, each said attachment defines a stop on said apron which is configured for receiving said outlet of said barrel, said stop is disposed on said apron to properly align said engagement formation with said corresponding at least one complementary formation for ensuring releasable locking engagement between said attachment and said barrel, said attachment is dimensioned to slidably and rotatably engage said barrel.

22. An aeration barrel attachment for use with a hand held hair dryer having a barrel with an outlet, said attachment comprising:

a substantially tubular body with a perforated sidewall;

a first end for receiving the barrel, and a second end configured for blocking airflow, such that all air flowing into said attachment from the barrel outlet flows radially through said sidewall.

23. The attachment of claim 22 wherein said first end is configured as an apron having an opening for receiving the barrel and at least one complementary formation constructed and arranged for engaging a corresponding at least one engagement formation on the barrel, and a stop axially spaced from said opening, said stop being constructed and arranged for receiving the barrel outlet and for positioning said attachment so that said complementary formations engage the at least one engagement formation.

24. The combination of claim 22 further including a plurality of spaced, radially projecting annular ribs provided to said sidewall, adjacent the openings of said sidewall, and configured for parting and separating hair.

25. The combination of claim 11 wherein said at least one engagement formation is a radially extending lug.

26. The combination of claim 11 wherein said at least one engagement formation is a plurality of formations disposed at approximate 90° intervals around said barrel.

27. The combination of claim 11 wherein said at least one engagement formation is a plurality of formations disposed at approximate 45° intervals around said barrel.

* * * * *